US009097128B2

(12) United States Patent
Piersall et al.

(10) Patent No.: US 9,097,128 B2
(45) Date of Patent: Aug. 4, 2015

(54) SEALS FOR ROTARY DEVICES AND METHODS OF PRODUCING THE SAME

(75) Inventors: Matthew Robert Piersall, Greenville, SC (US); Spencer Aaron Kareff, Greenville, SC (US)

(73) Assignee: General Electric Company, Schenectady, NY (US)

( * ) Notice: Subject to any disclaimer, the term of this patent is extended or adjusted under 35 U.S.C. 154(b) by 613 days.

(21) Appl. No.: 13/407,099

(22) Filed: Feb. 28, 2012

(65) Prior Publication Data

US 2013/0224026 A1 Aug. 29, 2013

(51) Int. Cl.
*F01D 11/00* (2006.01)

(52) U.S. Cl.
CPC ..... *F01D 11/001* (2013.01)

(58) Field of Classification Search
CPC ..... F01D 11/02
USPC ..... 415/170.1, 174.3, 174.2, 174.5
See application file for complete search history.

(56) References Cited

U.S. PATENT DOCUMENTS

| | | | | |
|---|---|---|---|---|
| 5,222,742 | A | 6/1993 | Roberts | |
| 5,967,745 | A | 10/1999 | Tomita et al. | |
| 6,189,891 | B1 * | 2/2001 | Tomita et al. | 277/414 |
| 6,506,016 | B1 | 1/2003 | Wang | |
| 6,669,443 | B2 | 12/2003 | Burnett et al. | |
| 6,779,972 | B2 | 8/2004 | Farrell et al. | |
| 6,890,150 | B2 | 5/2005 | Tomberg | |
| 7,967,559 | B2 | 6/2011 | Bunker | |
| 8,167,547 | B2 * | 5/2012 | Wu et al. | 415/173.5 |
| 2004/0109786 | A1 * | 6/2004 | O'Hara et al. | 420/444 |
| 2007/0098545 | A1 * | 5/2007 | Alvanos et al. | 415/170.1 |
| 2008/0124215 | A1 * | 5/2008 | Paolillo et al. | 415/173.7 |
| 2008/0263863 | A1 * | 10/2008 | Rose | 29/889.1 |

* cited by examiner

*Primary Examiner* — Dwayne J White
*Assistant Examiner* — Jason Fountain
(74) *Attorney, Agent, or Firm* — Armstrong Teasdale LLP

(57) ABSTRACT

A seal for a turbine engine is provided that includes a seal body disposed at a base of a turbine engine blade and a wing portion extending axially from the seal body. The wing portion has a first portion substantially parallel with a centerline of the engine and an angled upturn portion. The first portion extends between the seal body and the angled upturn portion. An angle between the engine centerline and the angled upturn portion is between about 0 degrees and about 90 degrees.

8 Claims, 4 Drawing Sheets

SEALS FOR ROTARY DEVICES AND METHODS OF PRODUCING THE SAME

BACKGROUND OF THE INVENTION

The present invention relates generally to rotary machines and, more particularly, to angel wing seals.

Rotor assemblies used with turbine engines include a row of circumferentially-spaced rotor blades. Each rotor blade, sometimes referred to as a "bucket" includes an airfoil that includes a pressure side and a suction side that are connected together along leading and trailing edges. Each bucket extends radially outward from a bucket platform. Each bucket typically includes a dovetail that extends radially inward from a shank extending between the platform and the dovetail. The dovetail is used to couple the rotor blade to a rotor disk or spool.

Wheel space cavities, defined between the rotating parts, such as the buckets, and the stationary parts of gas turbines, may be purged with cooling air to maintain the temperature of the wheel space and rotor within a desired temperature range, and to prevent hot gas path ingestion into the cavities. Seals are provided to seal the wheel space cavity. At least some known rotor blades include "angel wing seals" that extend generally axially away from the blades to form a seal by overlapping with nozzle seal lands extending from fixed components in the gas turbine. Typically, angel wing seals are cast integrally with the blade and are generally substantially planar, in cross-section, or include a preformed 90° bend at the tip that enables a portion of the angel wing to extend substantially perpendicular to the turbine engine centerline. Thus, if the angel wing seals need to be adjusted, for example to change a gap size with respect to an adjacent engine component, the gap size may be changed with respect to one direction only (i.e., axial or radial) by grinding down the angel wing seal.

BRIEF DESCRIPTION OF THE INVENTION

In one aspect, a seal for a turbine engine includes a seal body disposed at a base of a turbine engine blade and a wing portion extending axially from said seal body. The wing portion has a first portion substantially parallel to a centerline of the engine and an angled upturn portion. The first portion is disposed between the seal body and the angled upturn portion. An angle between the angled upturn portion and the centerline of the engine is between 0 degrees and 90 degrees.

In another aspect, a method of producing a seal for a turbine engine includes forming a mold for casting the seal. The mold includes a seal body portion for forming a base of a turbine engine blade, and a wing portion for forming an angel wing extending axially from said seal body. The angel wing includes a first portion substantially parallel to a centerline of the engine and an angled upturn portion, the first portion is disposed between the seal body and the angled upturn portion. An angle between the angled upturn portion and the centerline of the engine is between 0 degrees and 90 degrees. The method also includes casting the seal using the mold.

In yet another aspect, a turbine engine arrangement includes a stationary component and a rotating component having a plurality of turbine blades. Each of the turbine blades includes a seal body disposed at a base of a turbine engine blade and a wing portion extending axially from the seal body. The wing portion has a first portion substantially parallel to a centerline of the engine and an angled upturn portion. The first portion is disposed between the seal body and the angled upturn portion. An angle between the angled upturn portion and the centerline of the engine is between 0 degrees and 90 degrees.

DETAILED DESCRIPTION OF THE INVENTION

Figure 1:
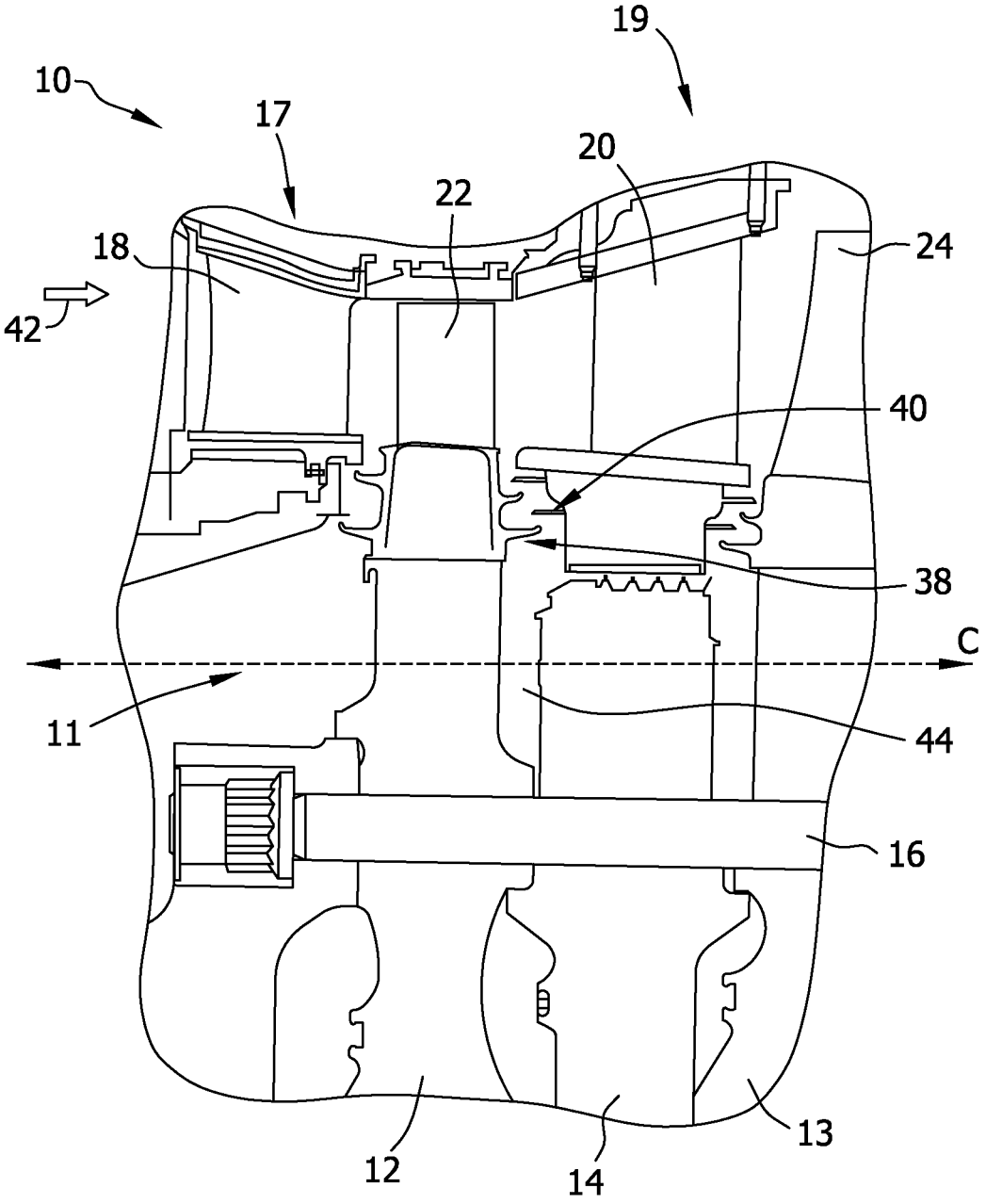
FIG. 1 shows a cross section of an exemplary gas turbine.

FIG. 1 shows illustrates a portion of an exemplary gas turbine 10 that includes a rotor 11 having axially-spaced rotor wheels 12, 13 and spacers 14 joined by a plurality of circumferentially spaced, axially extending fasteners 16. In one embodiment, turbine 10 includes a plurality of stages 17, 19 having first-stage nozzles 18 and second-stage nozzles 20. In one embodiment, a plurality of rotor blades 22, 24, for example, first-stage rotor blades 22 and second-stage rotor blades 24 are circumferentially spaced about rotor wheels 12, 13 between first-stage nozzles 18 and second-stage nozzles 20. First-stage rotor blades 22 and second-stage rotor blades 24 are rotatable with the rotor wheels 12, 13.

Figure 2:
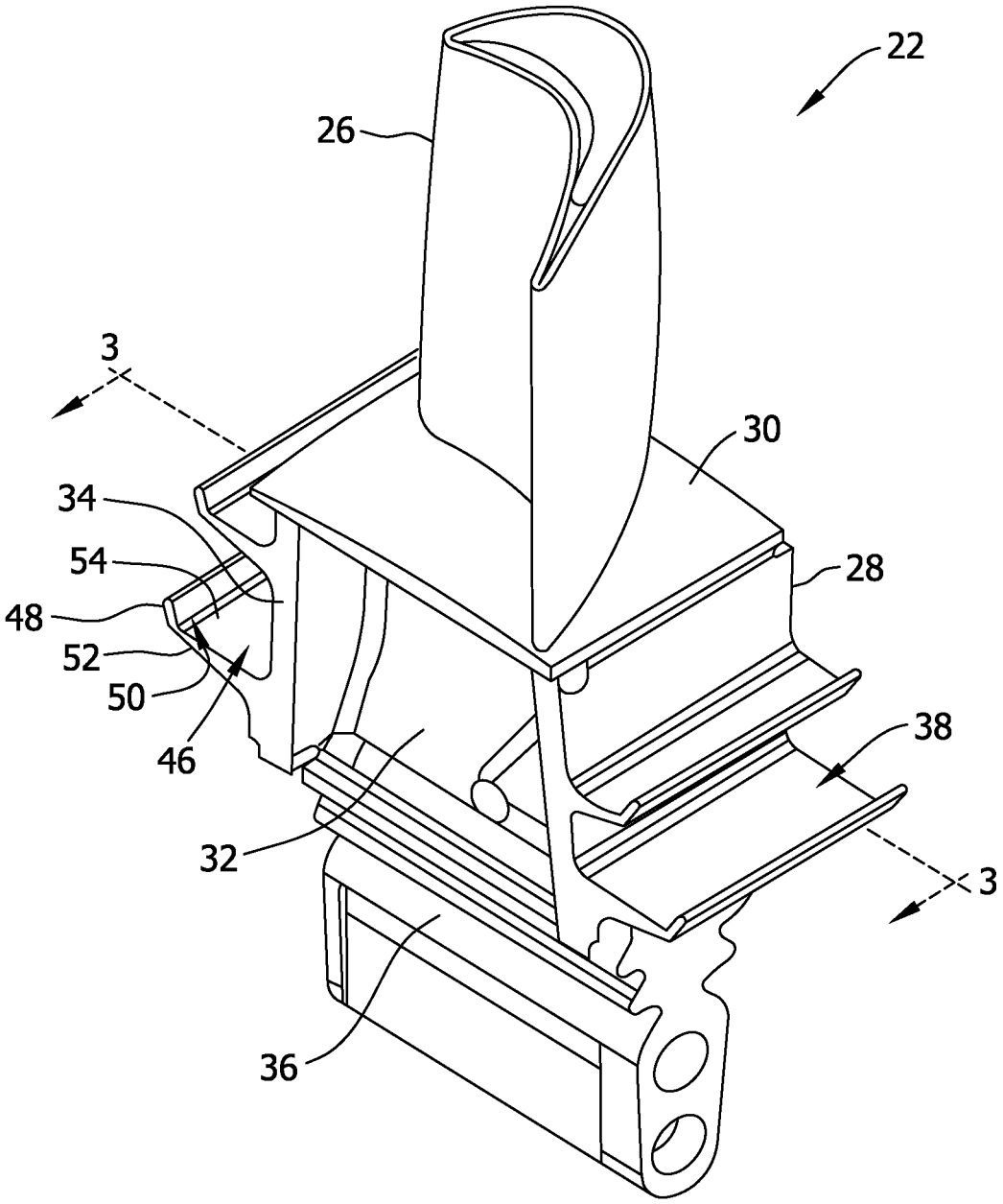
FIG. 2 shows an enlarged perspective view of an exemplary turbine blade that may be used with the gas turbine shown in FIG. 1.

FIG. 2 illustrates an exemplary first-stage rotor blade 22 used with turbine 10. In the exemplary embodiment, rotor blade 22 includes an airfoil 26 extending from a shank 28. Shank 28 includes a platform 30 and a shank pocket 32 having cover plates 34. A dovetail 36 extends partially from shank 28 to enable airfoil 26 to couple with rotor wheel 12 (shown in FIG. 1). In the exemplary embodiment angel wing seals 38 extend outward from rotor blade 22. Angel wing seals 38 are configured to overlap with lands 40 (shown in FIG. 1) formed on an adjacent nozzle to form a seal. In one embodiment, the angel wing seals 38 are configured to limit ingestion of the hot gases flowing through the hot gas path 42 into wheel spaces 44.

In the exemplary embodiment, angel wing seals 38 include an angel wing body 46 and an angled upturn portion 48 at a distal end thereof and one or more curved root blends 50. Angel wing seals 38 include a lower seal body surface 52 and an upper seal body surface 54. In the exemplary embodiment, lower seal body surface 52 and upper seal body surface 54 are substantially parallel to engine centerline C.

Figure 3:
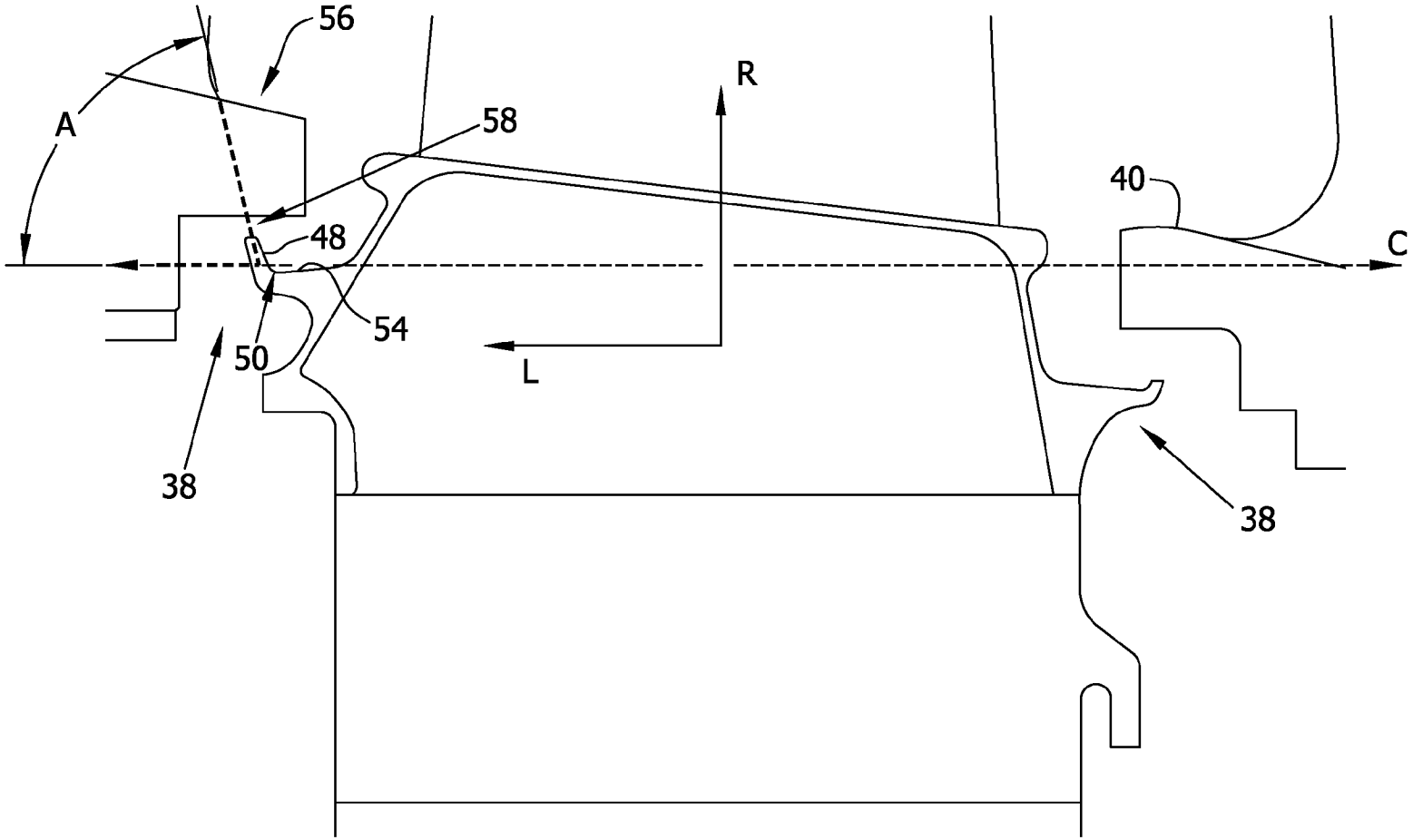
FIG. 3 shows a cross section of the turbine blade shown in FIG. 2 and taken along line 3-3.

FIG. 3 illustrates a cross-section of a portion of rotor blade 22. In the exemplary embodiment, angled upturn portion 48 is disposed at an angle A with respect to engine centerline C. Angle A is an angle between about 0 degrees and 90 degrees, more particularly between about 60 degrees and 70 degrees. In one embodiment, angle A is about 65 degrees. In the exemplary embodiment, at least a portion of angel wing seal 38 overlaps a portion of stationary part 56 and thereby forms a seal with stationary part 56 of turbine 10. The interaction of angel wing seal 38 with stationary part 56, which forms the seal, substantially limits hot gasses from flow path 42 from passing through the seal.

In the exemplary embodiment, a gap 58 having an axial component and a radial component is formed between stationary part 56 and angel wing seal 38. The axial direction is indicated generally as direction L and the radial direction is indicated generally as direction R. Decreasing the size of gap 58 may increase the effectiveness of the seal. However, the size of gap 58 may fluctuate based upon a temperature of the components in turbine 10. For example, when all of the components are cold (i.e., during engine startup conditions), gap 58 may be a first size. After all of the components have warmed up (i.e., in a steady state operating condition), gap 58 may be a second size that is smaller than the first size. Angle A and the length of angled upturn portion 48 may be sized and configured to minimize the size of gap 58 during steady state conditions.

Figure 4:
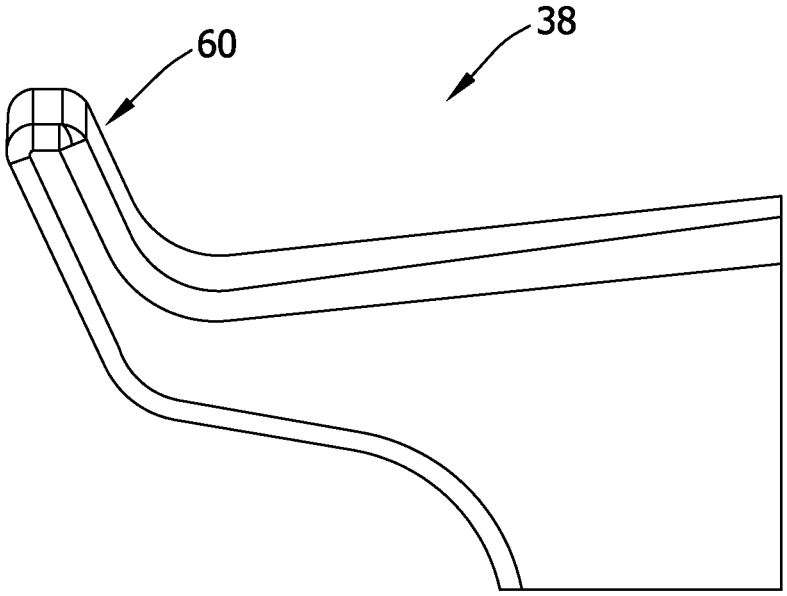
FIG. 4 shows a perspective view of an embodiment of an angel wing seal.

FIG. 4 shows a perspective view of an embodiment of angel wing seal 38. In the exemplary embodiment, angel wing seal 38 is formed, for example by casting, with a tuning portion 60. Tuning portion 60 facilitates tuning of gap 58 by providing extra material which can be removed to change the size of gap 58. As used herein, "tuning" refers to changing and/or optimizing the size of gap 58. For example, during start-up and shut-down conditions of turbine 10, the temperatures of the components are constantly changing, which creates a transient condition (i.e., a continuously changing size of gap 58). However, such transient conditions are not known until testing of turbine 10. If during testing it is determined that gap 58 is too small, in at least one of the axial and radial directions, a portion of tuning portion 60 may be removed, for example by machining, to increase the size of gap 58. Thus, because the angled upturn portion is angled from between 0 degrees and 90 degrees, it is possible to tune the radial and axial components of gap 58 without having to redesign, or recast, angel wing seal 38. In some embodiments, tuning portion 60 is between approximately 0.5 mm to 13 mm in length.

Angel wing seal 38 may be formed by casting. In such embodiment, a casting mold is formed of angel wing 38 for casting. In this embodiment, angle A may be set to maximize throughput of the casting process. In another embodiment, angle A may be set to provide a predetermined throughput (i.e., a number of castings per specified time period) of the casting process. In one embodiment, angel wing seal 38 is made of a nickel superalloy material. In another embodiment, angel wing seal 38 is integrally cast with one or more other components of turbine 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of producing a seal between a stationary component and a rotating component of a turbine engine, said method comprising:

forming a mold for casting the seal, said mold comprising:

a seal body portion for forming a base of a turbine engine blade;

a wing portion for forming an angel wing extending axially from said seal body, said angel wing comprising a first portion substantially parallel with a centerline of the turbine engine and an angled upturn portion, said first portion extending between the seal body and said angled upturn portion;

a tip portion extending from said wing portion, said tip portion for forming a tunable tip portion extending from said angled upturn portion, wherein said tip portion comprises space for a portion of material of said tunable tip portion to be cast therein;

wherein an angle defined between the engine centerline and the angled upturn portion is between about 0 degrees and about 90 degrees;

casting said seal using said mold;

determining that a size of a gap formed by the seal is too small in at least one of an axial direction and a radial direction, and tuning the size of the gap by removing an amount of the portion of material from said tunable tip portion such that the size of the gap is increased in at least one of the radial direction and the axial direction.

2. The method according to claim 1, further comprising filling said mold with a nickel superalloy material.

3. The method according to claim 1, wherein the mold further comprises an arcuate segment extending between said angled upturn portion and said first portion.

4. The method according to claim 1, wherein the seal body portion comprises a shank of a bucket in the turbine engine.

5. The method according to claim 1, wherein the angled upturn portion is configured to seal against the stationary component in the turbine engine.

6. The method according to claim 1, wherein the angled upturn portion is configured to overlap a portion of the stationary component.

7. The method according to claim 6, wherein the angled upturn portion is configured to overlap with lands formed on the stationary component.

8. The method of claim 1, wherein the angle defined between the engine centerline and the angled upturn portion is between about 60 degrees to 70 degrees.

* * * * *